US005833104A

United States Patent [19]

Horniak et al.

[11] Patent Number: 5,833,104

[45] Date of Patent: Nov. 10, 1998

[54] TICKET DISPENSING DEVICE

[75] Inventors: Stephen Horniak, 424 Cedar Hill Rd., Ambler, Pa. 19002; John Wingeron, Jr., Perkasie; John Colin Horniak, Ambler, both of Pa.

[73] Assignee: Stephen Horniak, Ambler, Pa.

[21] Appl. No.: 496,573

[22] Filed: Jun. 29, 1995

[51] Int. Cl.[6] ..... B26F 3/00

[52] U.S. Cl. ..... 225/106; 225/143; 225/90; 221/90; 221/197; 221/259; 226/188; 226/190; 83/210; 83/242

[58] Field of Search ..... 225/106, 43, 13, 225/52, 103, 16, 32, 90, 15, 51, 82, 85; 83/242, 210; 101/66, 69, 2, DIG. 44; 226/188, 144, 145, 190, 187; 221/259, 129, 13, 197, 2, 90; 242/595

[56] References Cited

U.S. PATENT DOCUMENTS

| | | | |
|---|---|---|---|
| 208,754 | 10/1878 | Morgan | 83/91 |
| 1,605,644 | 11/1926 | Carnahan | 83/257 |
| 2,000,159 | 5/1935 | Bolognino | 83/522.29 X |
| 2,036,207 | 4/1936 | Feddern et al. | 83/500 X |
| 2,097,486 | 11/1937 | Helsel | 83/522.29 X |
| 2,125,754 | 8/1938 | Steiner | 225/82 X |
| 2,193,759 | 3/1940 | Birr | 225/15 X |
| 2,487,061 | 11/1949 | Ptasnik | 225/23 X |
| 3,621,964 | 11/1971 | Riddle et al. | 250/548 X |
| 3,677,122 | 7/1972 | Rautine | 83/506 |
| 3,730,409 | 5/1973 | Ratti | 225/14 |
| 3,782,616 | 1/1974 | Surber, Jr. | 226/43 |
| 3,894,669 | 7/1975 | Wescoat | 225/103 |
| 3,935,978 | 2/1976 | Arp | 225/15 |
| 4,073,422 | 2/1978 | Palter | 226/129 |
| 4,204,618 | 5/1980 | Reed et al. | 225/106 |
| 4,272,007 | 6/1981 | Horniak | 226/187 |
| 4,653,667 | 3/1987 | Wettlen | 221/259 X |
| 5,076,483 | 12/1991 | Olesen | 227/131 |
| 5,113,758 | 5/1992 | Chou | 226/144 X |
| 5,211,093 | 5/1993 | Horniak | 83/426 |
| 5,503,318 | 4/1996 | Chou | 226/144 |

FOREIGN PATENT DOCUMENTS

| | | |
|---|---|---|
| 645798 | 11/1950 | United Kingdom . |

*Primary Examiner*—Maurina T. Rachuba
*Attorney, Agent, or Firm*—Synnestvedt & Lechner

[57] ABSTRACT

A ticket dispensing device having a braking system for preventing unauthorized removal of tickets. A drive roller advancing the ticket strip through the device is connected to a brake wheel. Pulling on the ticket moves the brake wheel into a braking member to impede the rotation of the drive roller, and thereby prevent removal of tickets. The ticket dispensing device also includes a face plate which can be easily and quickly removed to eliminate ticket jams.

20 Claims, 6 Drawing Sheets

TICKET DISPENSING DEVICE

BACKGROUND

1. Field of the Invention

This invention relates to ticket dispensing devices, and more particularly to an improved device that limits unauthorized withdrawal of additional tickets which have not been dispensed by the device.

2. Description of the Related Art

Devices for dispensing tickets are widely used for events such as movie theaters, concerts, sports and the like. After the desired number of tickets is paid for, an operator directs the device to dispense the specific number of tickets.

Another well-known use is with games such as those found in arcades. The ticket dispensing device automatically dispenses a predetermined number of tickets based upon the score achieved in the game. The tickets can then be exchanged for prizes or used to play additional games.

Other examples include coin-operated machines that dispense tickets after receiving the proper amount of money. Such devices can also be used to dispense stamps and other ticket-like units.

Ticket dispensing devices are well known in the art as represented in U.S. Pat. No. 4,272,001. The tickets are typically supplied to the device in rolls or flat folded sets of connected tickets. A power unit having a motor can be energized to advance one or more tickets from the device for dispensing. Once outside the device, the dispensed tickets are torn off from the ticket strip remaining within the device.

Unfortunately, security has become a concern with these devices. Instead of simply tearing off the dispensed tickets, unscrupulous users can attempt to remove additional unauthorized tickets from the device by pulling on the dispensed tickets strip without tearing the tickets.

Advances have been made to minimize this unauthorized removal of tickets. One such advance in wide use today is applicant's U.S. Pat. No. 4,272,001 which discloses a ratchet/sprawl (sprague)-type braking system. Although this device has significantly minimized unauthorized removal of tickets, slippage of this type braking system can occur, especially if certain tension adjustments are not correct. Further improvements in ticket dispensing devices are therefore needed to further protect from unauthorized removal.

Accordingly, one object of the present invention is to provide a more reliable security system for ticket dispensing devices.

Another object is to provide a simplified braking system that is less likely to fail.

A further object of the invention is to provide a braking system that automatically works.

A still further object is to provide a braking system in which the harder the dispensed ticket is pulled, the more braking force that is achieved.

Additional objects, advantages and novel features of the invention will be presented in part in the description which follows, and in part will become apparent to those skilled in the art upon examination of the following or may be learned by practice of the invention. The objects and advantages of the invention may be realized and attained by means of the features and combinations pointed out in the appended claims.

SUMMARY OF THE INVENTION

The present invention provides a unique braking system that redirects the unauthorized pulling force on the tickets to engage the braking system. Moreover, the greater the pulling force, the greater the braking.

A preferred embodiment of the invention provides a chassis for the device. Mounted to the chassis is a first roller. A drive roller which rotates about an axis is positioned to press the ticket between it and the first roller. To rotate the drive roller and advance the ticket, a drive assembly is rotatably connected to the drive roller. A brake wheel is rotatably connected to the drive roller for rotation with it and is spaced radially from the axis of the drive roller and supported on the drive assembly for movement with the drive assembly. A brake member is attached to the chassis. Unauthorized pulling on a ticket moves the brake wheel into and impedes the brake member to thereby impede rotation of the drive roller which, gripping the ticket, prevents the ticket from being pulled out. A pivot frame can be provided to support and direct the movement of the drive roller.

DESCRIPTION OF THE DRAWINGS

For the purpose of illustrating the invention, a preferred embodiment is shown in the drawings. It is understood, however, that this invention is not limited to the precise arrangement and instrumentalities shown.

DETAILED DESCRIPTION

Figure 1:
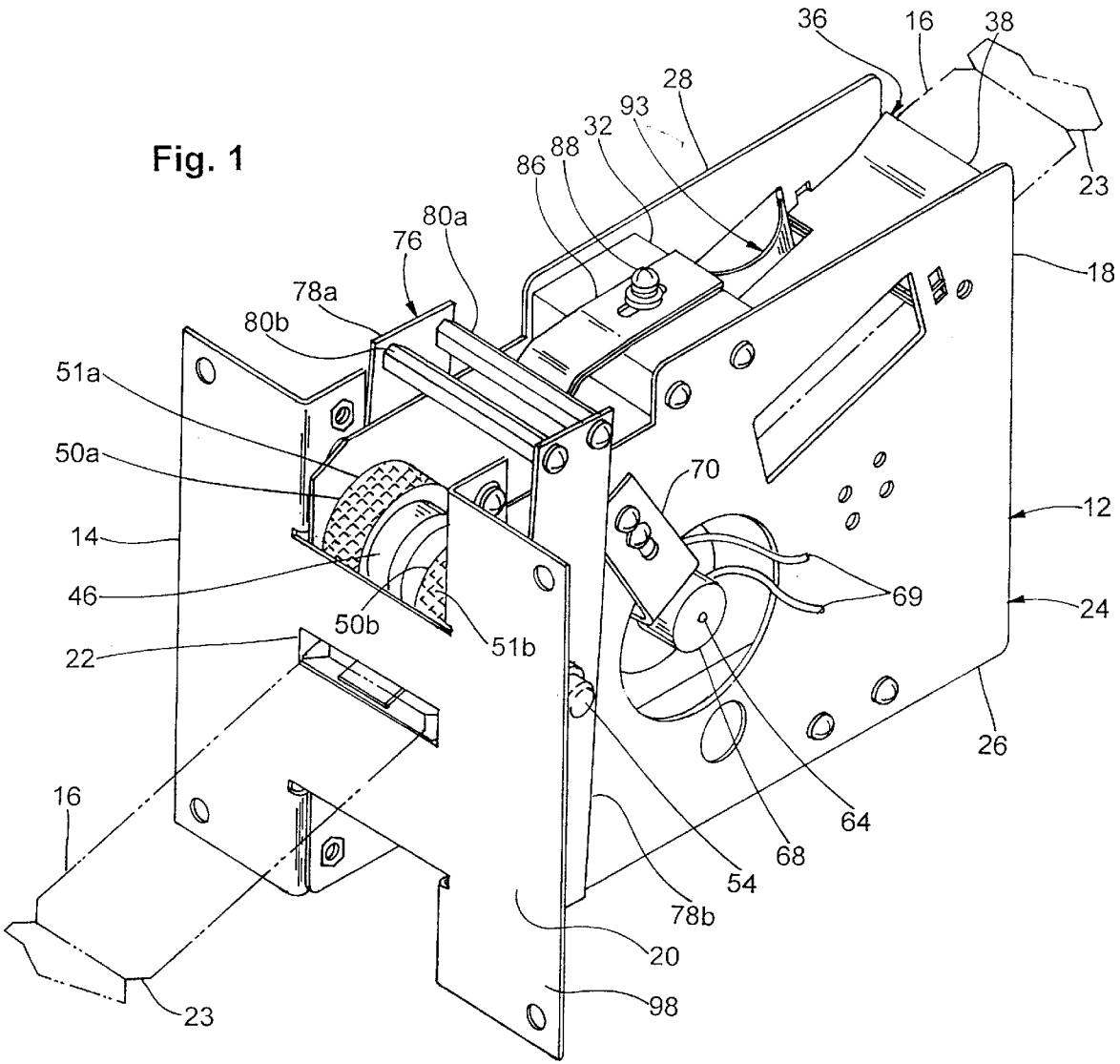
FIG. 1 is a perspective view of a ticket dispensing device of the preferred embodiment.

Illustrated in FIG. 1 is a ticket dispensing device 12 shown with its removable face plate 14. A strip of tickets 16 (shown in phantom) enters the device 12 on the ticket supply side 18 (the rear) of the device and exits on the ticket dispensing side 20 (the front) of the device through the dispensing slot 22 in the face plate 14.

The ticket strip 16 is advanced through the device as further described below to dispense one or more tickets as desired. Dispensed tickets are detached by simply tearing the tickets from the ticket strip remaining inside the device 12. The ticket strip 16 may be supplied in the form of a roll, a stack of tickets layered back and forth, or in any other acceptable format as may be known in the art. Notches 23 between the individual tickets are preferred to facilitate the tearing and detachment of the dispensed tickets. Those skilled in the art recognize that "tickets" as used herein refers to any ticket-like unit which may be dispensed from such devices, including ordinary tickets, stamps, and the like.

Referring now to FIGS. 1 to 7, the ticket dispensing device 12 has a chassis 24 for supporting the various elements of the device. The illustrated chassis 24 has frame plates 26 and 28 held in a spaced relationship by spacer rods 30*a*, 30*b* (FIG. 4) on the bottom, and a spacer block 32 (FIG. 1) on the top, each secured by screws as shown.

Figure 7:
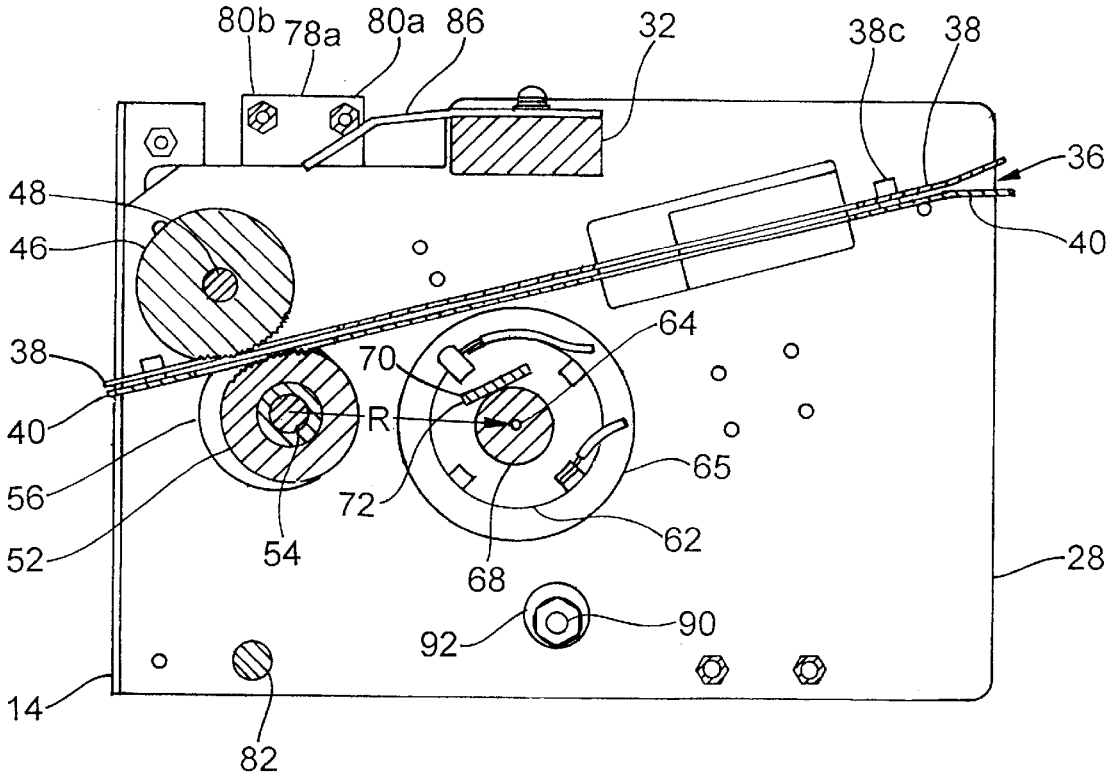
FIG. 7 is a side elevational view along line 7—7 of FIG. 5.
Figure 8:
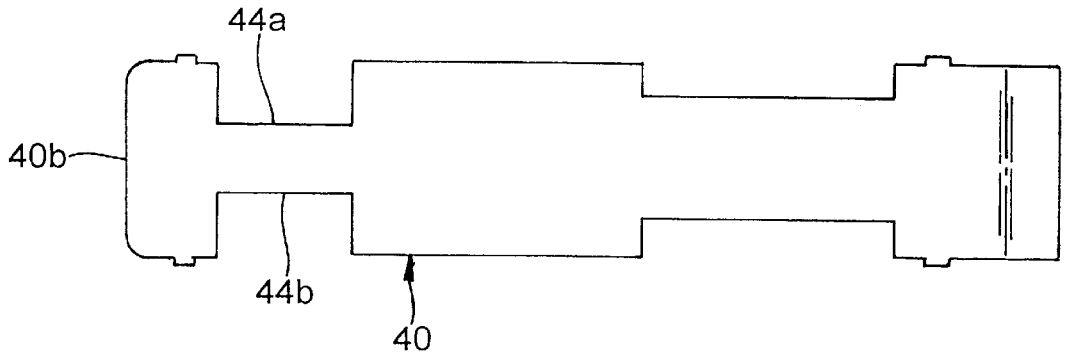
FIG. 8 is a plan view of the lower ticket guide plate of the device shown in FIG. 1.
Figure 9:
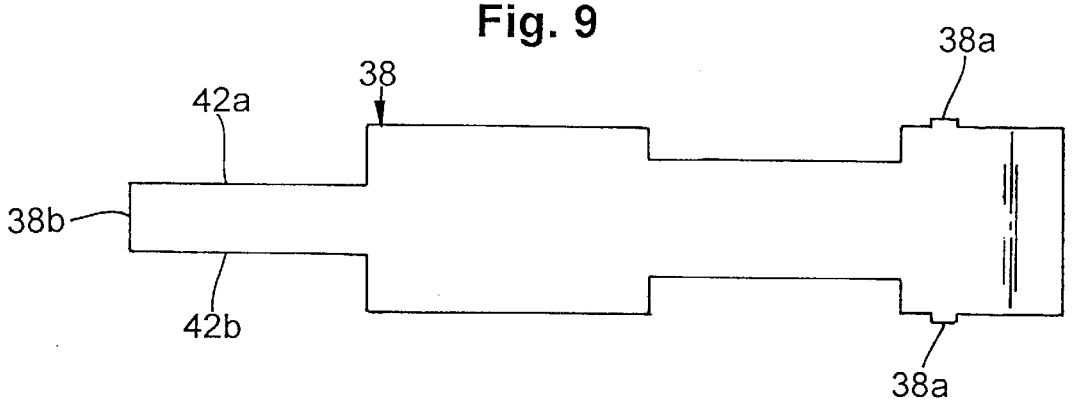
FIG. 9 is a plan view of the upper ticket guide plate of the device shown in FIG. 1.

The ticket strip 16 is preferably guided through the device 12 by a ticket guide 36. In the illustrated device, this ticket guide takes the form of a chute-like guide having upper and lower ticket guide plates 38 and 40, respectively (FIGS. 8 and 9), which are supported by the chassis frame plates 26 and 28. The ticket strip 16 advances between the two frame plates 26 and 28. As best seen in FIG. 7, the upper and lower ticket guide plates 38 and 40 have flared ends on the supply side 18 of the device to facilitate the loading of the ticket strip 16 into the device. Also, as illustrated in FIGS. 8 and 9, cutouts 42*a*, 42*b* and 44*a*, 44*b* in respective upper and lower ticket guide plates 38 and 40 permit rollers 46 and 52 to contact and advance the ticket strip 16 as described below.

As shown in FIG. 7, the forward ends 38*b* and 40*b*, respectively, of the upper and lower ticket guide plates 38 and 40 project through the ticket dispensing slot 22 in the face plate 14 to eliminate the possibility of jamming of tickets by tickets contacting the inner face of the face plate 14. Also, if, by any chance, jamming of the tickets occurs, for example by a user of the device blocking exit of the tickets through the dispensing slot, the jam can be easily corrected by removing the upper ticket guide plate 38 from between the side frame plates 26 and 28. As shown in FIGS. 7 and 9, the upper ticket guide plate 38 is held in position by support tabs 38*a*, 38*a* on either side of the rear of the upper ticket guide plate 38, which are engaged in elongated slots 38*c* in each of the frame plates 26 and 28. If a ticket jam occurs and it is necessary to remove the upper ticket guide plate 38, the chassis frame plates 26 and 28 can be manually moved away from each other to permit easy removal of the upper ticket guide plate 38. Repositioning of the upper ticket guide plate 38 after eliminating a ticket jam is accomplished in the same manner.

Rollers are provided to advance the ticket strips. A first roller 46 is rotatably mounted to the chassis 24. In the preferred embodiment, as shown in FIG. 1, the first roller 46 is freely rotatable (an idler roller) about a shaft 48 connected to the frame plates 26 and 28 above ticket guide 36. The first roller 46 is shown comprising two separate roller members 50*a*, 50*b*, each being centrally and annularly reduced in diameter so that the roller 46 properly constitutes end hub-like enlargements 51*a*, 51*b* which fit over cutouts 42*a*, 42*b* of the upper ticket guide plate 38. Each roller member 50*a*, 50*b* is freely rotatable in the present embodiment. The enlarged hub-like surfaces 51*a* and 51*b* can be knurled as shown to increase the frictional contact with the tickets.

A drive roller 52 is provided to advance the ticket strip. In its illustrated form, the drive roller 52 has a central portion 52*a* of reduced diameter (FIG. 4) so that the end hub-like portions 52*b* can contact the ticket strip 16 through the cutouts 44*a*, 44*b* in the ticket guide plate 40. The hub-like surfaces 52*b* are knurled as shown, or otherwise roughened as known in the art, to provide a frictional surface for engaging the ticket strip 16.

The drive roller 52 is rotatably driven by a drive assembly 60 to advance the tickets. As best seen in FIGS. 1 and 7, the ticket strip 16 is engaged between the drive roller 52 from below and the first roller 46 from above through the cutouts 42*a*, 42*b* and 44*a*, 44*b* in the upper and lower ticket guide plates 38, 40. As the drive roller 52 is rotated, the ticket strip 16 is frictionally engaged between the two rollers 52, 54 and is advanced accordingly. Proper frictional contact between the two rollers and the ticket is maintained by biasing the drive roller 52 into the first roller 46 as further discussed below. The drive roller 52 is rotatably mounted on a drive shaft 54 extending through cutouts 56 in the chassis frame plates 26, 28, which in turn, is supported by a pivot frame 76. It is seen that the drive roller 52 and drive shaft 54 rotate about an axis 58 passing through the drive shaft 54.

The drive assembly 60 rotates the drive roller 52 to advance the ticket strip 16. Rotatably connected to the drive roller 52 through shaft 54, the drive assembly 60 of the present embodiment has an electric motor 62 having a motor shaft 64 which, through a transmission means, is connected to the shaft 54. The transmission means may be any suitable type as known in the art, such as gears and belts, and preferably has a reduction ratio whereby the motor shaft 64 rotates at a much higher rate than the drive roller 52. The motor 62 is seen extending into the interior of the device through a hole 65 in the side plate 28. The motor wires 69 are illustrated.

A cylindrical brake wheel 68 is rotatably connected to the drive roller 52 to rotate and move with the drive roller 52. Thus, if the brake wheel 68 is prevented from rotating, so is the drive roller 52. Likewise, rotational movement of the drive roller 52, such as in the direction towards the dispensing side 20 of the device 12, causes a corresponding movement of the brake wheel 68. The brake wheel 68 is mounted on the motor drive shaft 64. As the motor shaft 64 is connected to the drive roller 52 through the transmission means and the drive shaft 54, it is seen that the brake wheel 68 is rotatably connected thereto.

Figure 4:
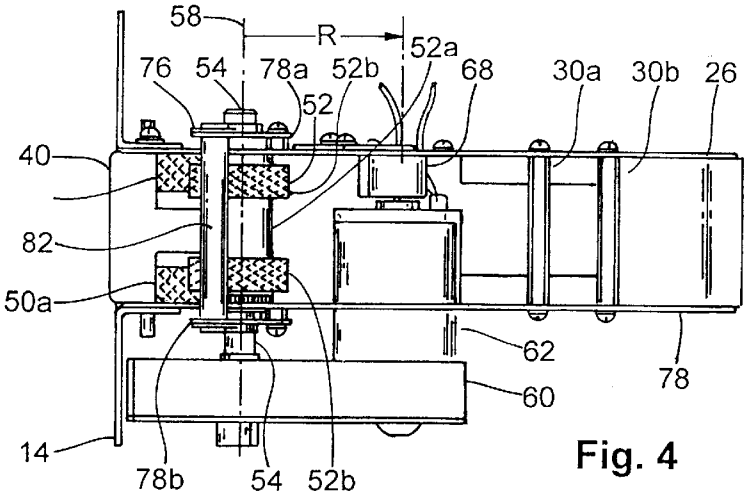
FIG. 4 is a bottom elevational view along line 4—4 of FIG. 2.
Figure 5:
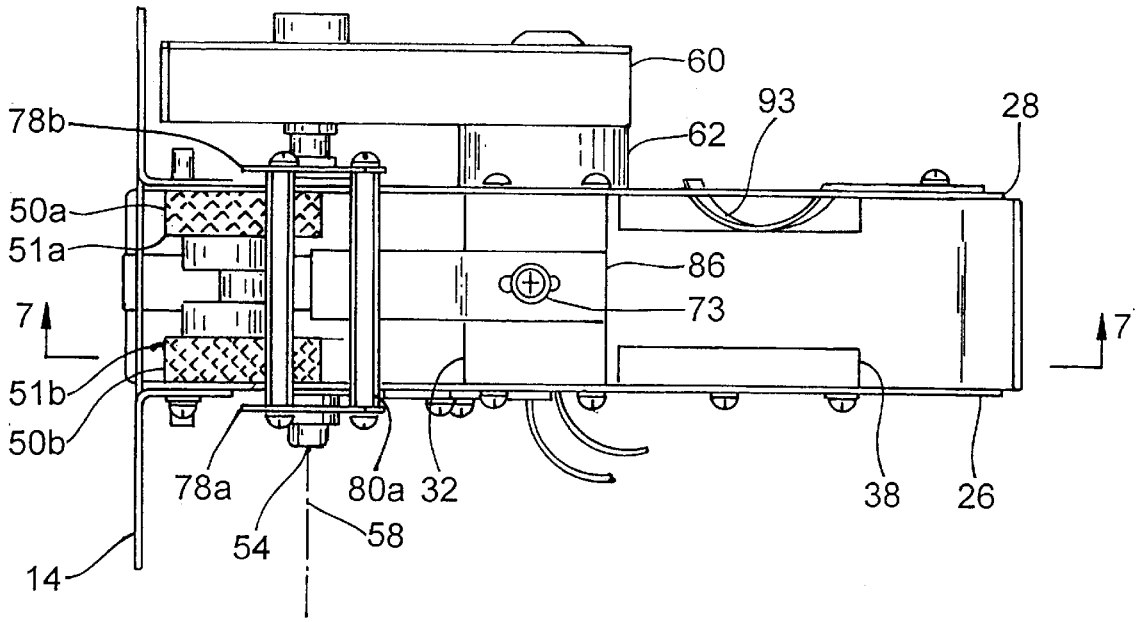
FIG. 5 is a top elevational view along line 5—5 of FIG. 2.
Figure 6:
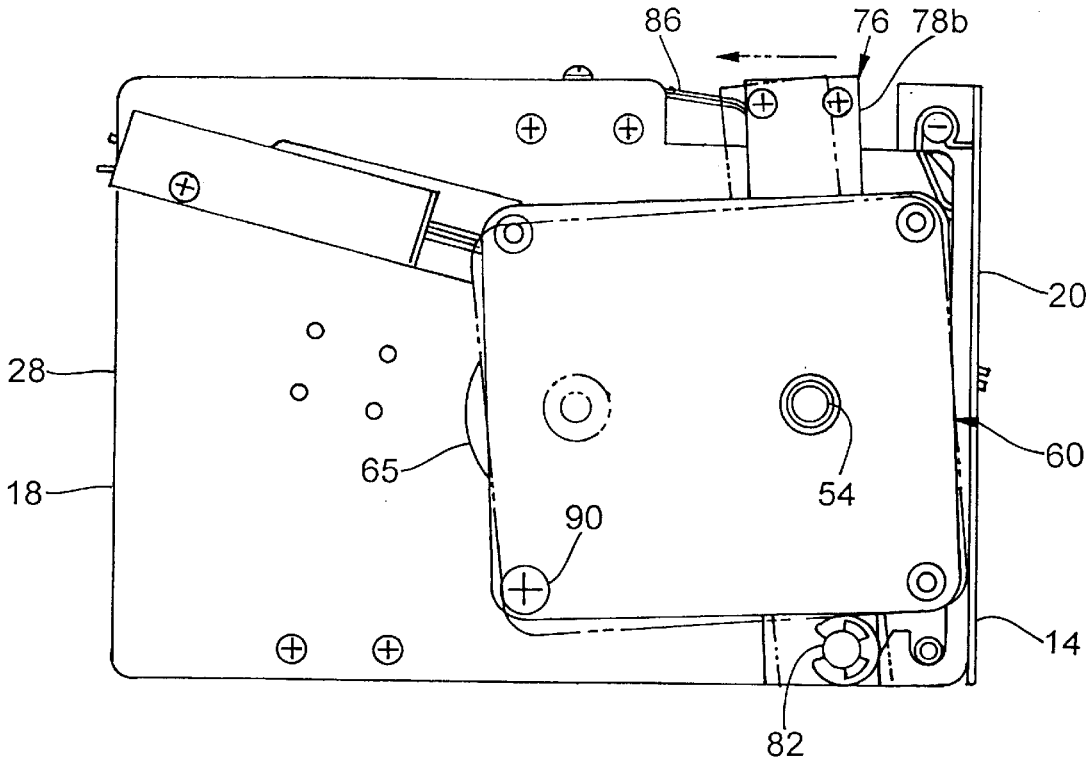
FIG. 6 is a side elevational view along line 6—6 of FIG. 3.

As seen in FIGS. 4 and 5, the brake wheel 68 is supported on the drive assembly 60 via the motor shaft 64 of the motor 62. Moreover, the brake wheel 68 is spaced radially from the axis 58 of the drive roller 52 (see radius R in FIG. 4). Thus, should the drive assembly 60 move or pivot about the axis 58, it is seen that the brake wheel 68, attached to the drive assembly 60, will necessarily move with the drive assembly 60 in a corresponding manner about the axis 58, although such movement is limited by a pin 90 as further described below.

The brake wheel 68 can be made of polyurethane which provides good braking action when engaging a brake member 70. The brake member 70 is a fixed member into which the brake wheel 68 is movably engaged to impede the rotation of the brake wheel 68. This in turn impedes the rotation of the drive roller 52 rotatably connected thereto. In the form illustrated, the brake member 70 is a bracket-like piece of metal having a flat bent end 72 for engaging the brake wheel 68. It is affixed to the chassis frame plate 26 by screws 74.

Figure 11:
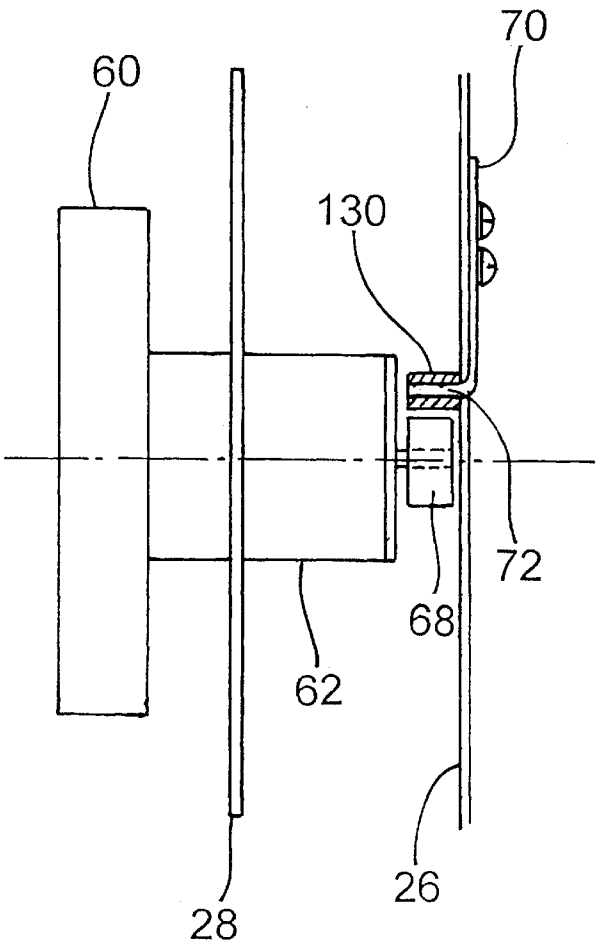
FIG. 11 is an elevational view of a second embodiment of the brake wheel and brake member.
Figure 12:
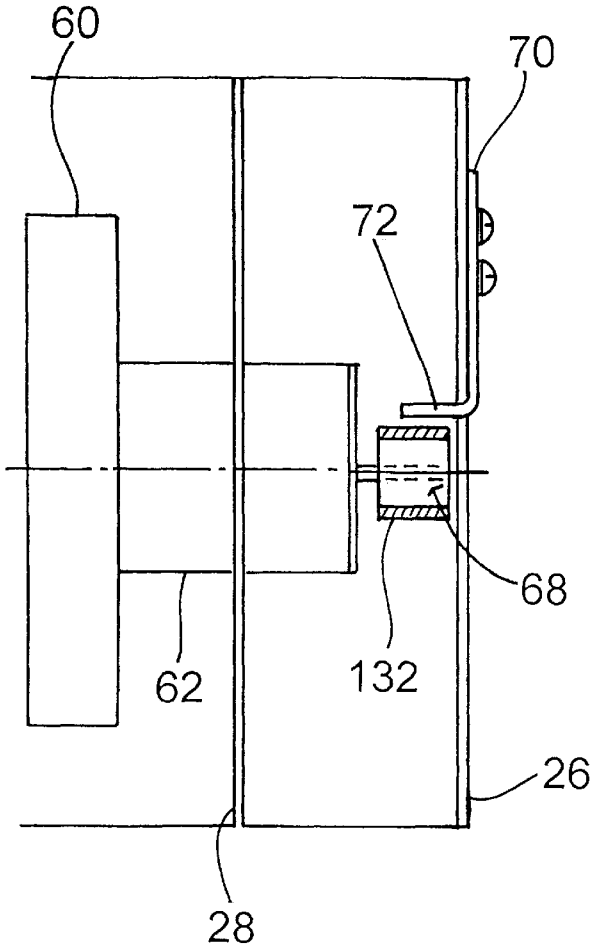
FIG. 12 is an elevational view of a third embodiment of the brake wheel and brake member.

FIGS. 11 and 12 illustrate additional embodiments of the brake wheel 68 and brake member 70. In FIG. 11 the brake wheel 68 is made of metal such as aluminum, brass, steel or other suitable material for providing good braking action when engaging the brake member 70. The brake member 70 preferably has a polyurethane sleeve 130 attached to the flat bent end 72 for engaging the brake wheel 68 (here shown attached around the bent end 72). Another alternative, as shown in FIG. 12, is to provide a polyurethane sleeve 132 over the brake wheel 68 for engaging the brake member 70 which here is made of metal. Any other combination of materials in the brake wheel 68 and brake member 70 which provides a positive frictional stop when engaged, may also be utilized.

Figure 2:
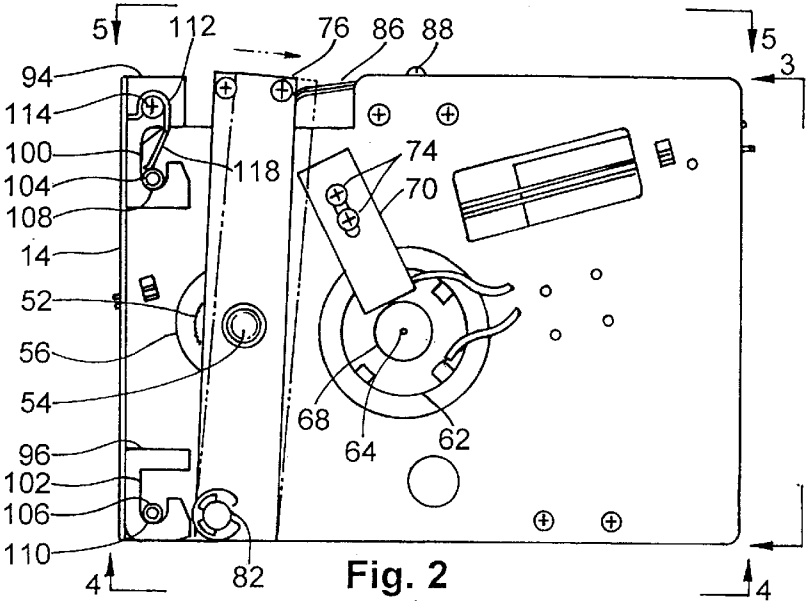
FIG. 2 is a side elevational view of the device shown in FIG. 1.

A pivot frame 76, movably connected to the chassis 24, supports the drive roller 52 and directs the movement of the brake wheel 68 so as to move the brake wheel 68 to engage the brake member 70 when the drive roller 52 is moved toward the front of the device 12. In the illustrated form, the pivot frame 76 comprises two pivot frame brackets 78*a*, 78*b* held in a spaced relationship on the outside of the chassis frame plates 26 and 28 by the top bracket spacers 80*a*, 80*b*, and the bracket pivot shaft 82 on the bottom. The pivot frame 76 is movably connected to the chassis 24 through the pivot shaft or pivot connector 82, about which the pivot frame 76 can pivot or swing as illustrated in FIG. 2. However, any means for pivotally connecting the pivot frame 76 to the chassis 24 as known in the art may be used.

The drive roller shaft 54 is seen extending through and supported by the pivot brackets 78*a*, 78*b*. Cutouts 56 in each chassis frame plate 26 and 28, through which the drive roller 52 and its shaft 54 extend, permit the necessary pivotable movement of the pivot frame 76 about the pivot shaft 82 without interference from the chassis 24.

As best seen in FIGS. 2 and 7, the axis 58 of the drive shaft 54 and the drive roller 52 lies just behind an imaginary plane passing through the axis of the first roller shaft 48 and pivot shaft 82. As the pivot frame 76 pivots counter-clockwise (FIG. 7), it is seen that the drive roller 52 moves in a frontwardly and upwardly direction closer to the first roller 46. Thus, any counter-clockwise movement of the pivot frame, such as from applying force directly to the drive roller 52 by pulling the ticket strip moves the drive roller 52 further towards the first roller 46, thereby more tightly gripping the ticket strip between the two rollers.

A biasing member 86 is provided to urge the pivot frame 76 forward into its operational position whereby the drive roller 52 is positioned to provide the proper contact force to the ticket strip 16 between it and the first roller 46. As shown, the biasing member can take the form of a leaf spring affixed to the top of the chassis 24 with a screw 88, although any biasing means as known in the art may be used.

To load the ticket strip 16, the pivot frame 76 is pushed clockwise (FIG. 2) against the biasing member 86 to increase the distance between the drive roller 52 and the first roller 46. After the ticket strip is loaded, the pivot frame is released and urged by biasing member 86 back to its normal operating position. The pivotable movement of the pivot frame 76 is limited by the biasing member 86 on the back side, and the first roller 46 which contacts the drive roller 52 to prevent further movement toward the front.

As previously described, the drive roller shaft 54 extends through the pivot frame 76 to the drive assembly 60 to which it is rotatably connected. The drive assembly 60, being supported by the shaft 54, is thus supported by the pivot frame 76. It is seen that the drive assembly 60 and the members connected to it (motor 62, motor shaft 64, brake wheel 68) move with the drive roller 52 and its shaft 54 when the pivot frame 76 pivots about its shaft 82.

Figure 3:
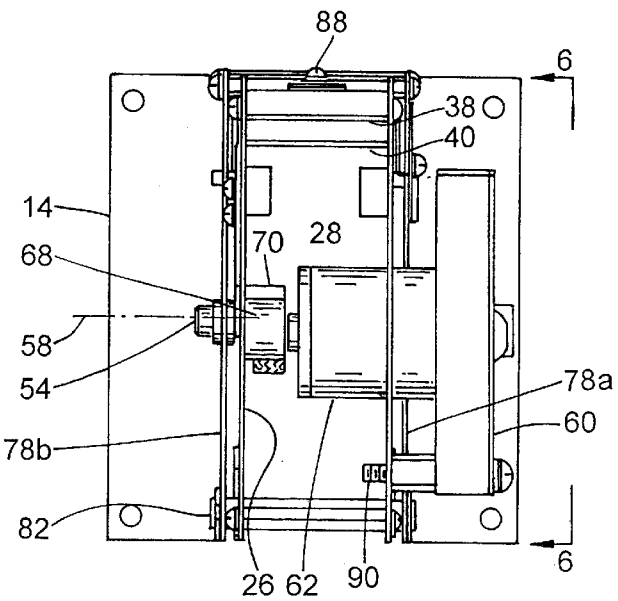
FIG. 3 is a rear elevational view along line 3—3 of FIG. 2.

Affixed to drive assembly 60 is the pin 90 extending through a hole 92 in the frame plate 28. (FIGS. 3, 7). The hole 92 is sized larger than the pin 90 to allow enough slack so that the drive assembly 60 can move with the pivot frame 76 while limiting any rotational (pivotal) movement of the drive assembly 60 about the drive roller axis 58. The pin 90 can comprise any suitable member extendable through a hole in the frame plate.

To operate the device 12, the electric motor 62 is energized to rotate the drive roller 54 which bears on the ticket strip between it and the first roller 46. One or more tickets is advanced in this manner and dispensed through the dispensing slot 22 in the front of the device as is known in the art. One such device dispensing tickets in this manner is disclosed in U.S. Pat. No. 4,272,001 which is hereby incorporated by reference.

The device is preferably operated by a solid state motor controller (not shown) which provides dynamic braking to ensure accurate and repeatable ticket stopping after issuing any number of tickets. Included as part of such a controller can be a sensing means of an opto-electronic beam breaker sensor, which detects the notches between the tickets. Such controllers and sensors are known in the art. A ticket guide spring 93 secured to the chassis can be provided to bias the ticket strip through a sensor.

The tickets dispensed to the outside of the device 12 remain connected to the ticket strip inside the device until torn off. If, however, the dispensed ticket is pulled in an effort to withdraw additional unauthorized tickets from the device 12, this action will cause the braking system to bind the tickets between the two rollers. Pulling on the ticket strip pulls the drive roller 52 forward. Pivoting with the pivot frame 76, the drive roller 52 is directed closer to the first roller 46, thereby gripping the tickets more firmly and with greater frictional force. Likewise, the brake wheel 68, which in the present form is rotatably connected to the drive roller 52 through the motor drive shaft 64 of the drive assembly 60, is directed by the pivot frame 76 to move into the flat bent end 72 of braking member 70. It is further seen that any slight clockwise rotation (with reference to FIG. 6) of the drive roller 52 such as that due to pulling of a ticket will rotate the drive shaft 54 enough to also rotate (pivot) the drive assembly 60 clockwise. The brake wheel 68, being attached to the motor of the drive assembly, will move therewith towards the brake member 70 (moving counter-clockwise about shaft 54 with reference to FIG. 7). This impedes the ability of the brake wheel 68 to freely rotate, which in turn impedes the ability of the drive roller 52, connected thereto, to rotate.

A major advantage of the braking system is that the harder one pulls on the ticket, the greater the braking force applied. The more pull on the ticket, the more the drive roller 52 is directed into the first roller 46 by the pivot frame 76 to more tightly grip the ticket between it and the first roller. This prevents slippage of the tickets between the rollers. Further, since the brake wheel 68 moves with the drive roller 52, greater pull on the ticket causes greater braking force to be applied to the brake wheel 68.

This is a simple braking system having few working parts, making the system extremely reliable and less prone to slippage and system failure. It is also seen that the braking system automatically works. When, as in the present embodiment, a reduction transmission is used such that the brake wheel 68 rotates at a much higher rate than the drive roller 52, the braking force applied to the brake wheel 68 translates to a much larger braking force at the drive roller 52.

When the motor is next engaged to turn the drive roller 52 for dispensing tickets, the reverse reaction torque in the drive assembly 60 tends to turn the drive assembly 60 and the brake wheel 68 attached thereto in the direction opposite the rotation of the drive roller 52. The consequent counter rotation of the drive assembly 60 is believed to help reposition the pivot frame 76 and the drive roller 52 supported thereon back to its operational position.

The front face plate 14 provides quick separation and relocking to the chassis 24. Separation is necessary to unjam or repair the ticket feed mechanism. Quick separation and relocking allows the device to be more quickly returned to operation.

Figure 10:
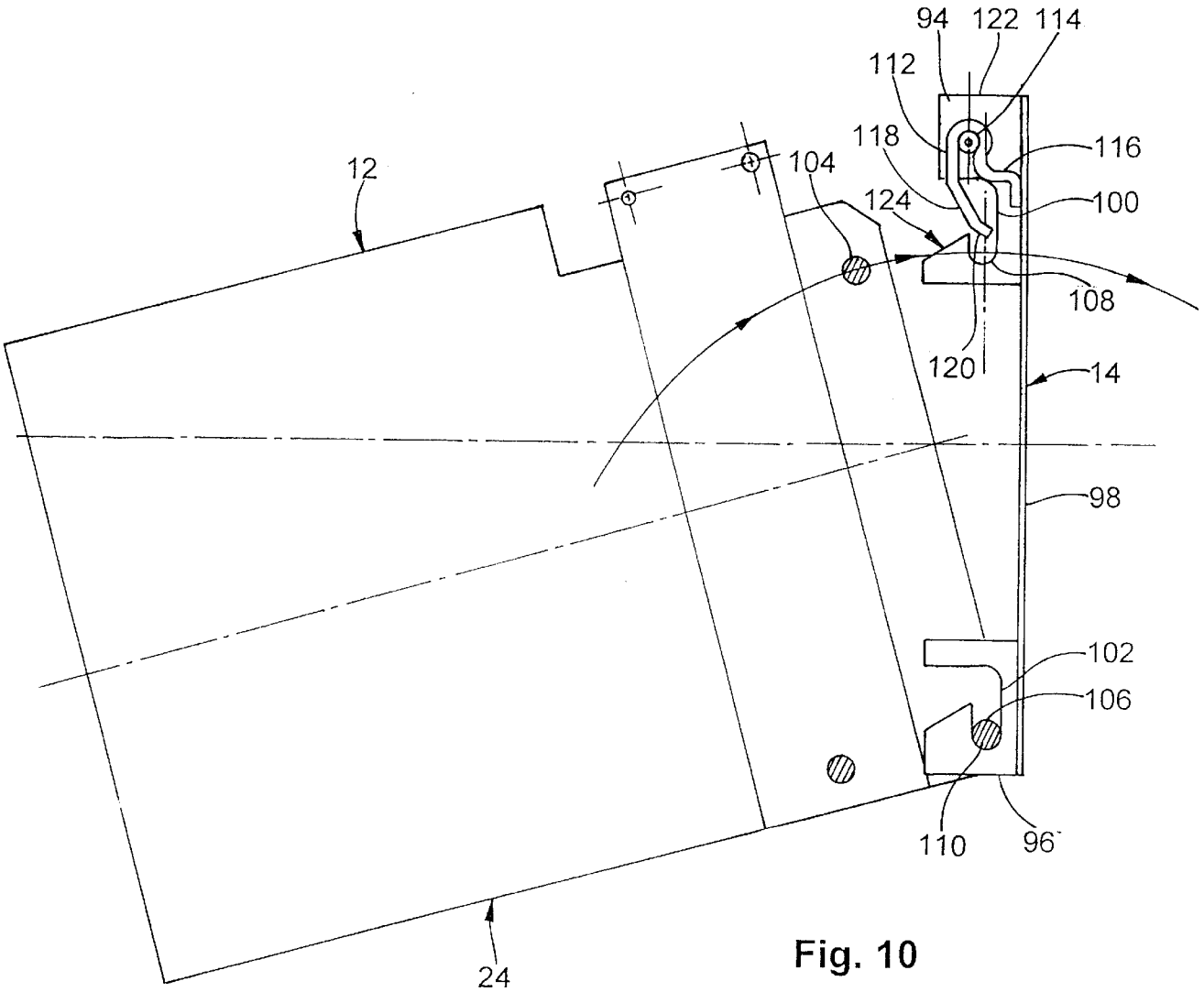
FIG. 10 is a plan view of the side of a ticket dispensing device showing the removable face plate.

Referring to FIGS. 1, 2 and 10, the front face plate 14 has a forward surface 98 and the ticket slot 22. Positioned on the upper back side of the forward surface 98 of the face plate 22 are two locking slots 94 having cutouts 100 to accept locking pins 104 (only one locking slot 94 is shown, the other being on the opposite side of the front plate 98). Two hinge slots 96 having cutouts 102 to accept hinge pins 106, are provided on both sides of the lower portion of the face plate 14.

The locking slots 94 and hinge slots 96 are preferably made of metal formed with or affixed to the face plate 14, and each has a pin slot 108, 110 respectively into which the upper and lower locking pins 104, 106, respectively, fit. The locking pins 104, 106 are preferably Perm-Nuts mounted as stand-offs on the ticket dispenser chassis.

The locking slots 94 further have a locking spring 112 secured around an axle pin 114 by a screw as shown and has one bent end 116 contacting the front plate 98 to prevent rotation of the locking spring 112 about the axle pin 114. The locking spring 112 also has a directional leg 118 having an angled end 120 as shown. The locking spring 112 is preferably made of hardened music wire of 0.049" diameter spring tempered.

To install the face plate 14, the lower locking pins 106 are inserted into the hinge slots 96. The face plate 14 is then lifted and rotated counter-clockwise about the lower locking pins 106 (FIG. 10) until the upper locking pins 104 reach the directional leg 118 of the locking spring 112. The front angle 124 (FIG. 10) on the locking slots 94 help direct the upper locking pins 104 into position. Additional pushing of the face plate 14 against the locking spring directional leg 118 forces the upper locking pins 104 into the pin slot 108. At that point the angled end 120 of the locking spring 112 will lock the face plate 14 onto the chassis 24.

To remove the face plate 14, downward pressure is applied to the top 122 of the face plate, pushing the upper locking pins 104 into the directional leg 118 which pushes the upper locking pins 104 out of the cutouts 100 once the upper locking pins 104 clear the pin slot 108.

This combination of the directional leg 118 of the locking spring 112 and pin slot 108 design allows the face plate 14 to quickly attach to the chassis 24. Further, the face plate 14 is locked onto the chassis 24 by the directional leg 118 so that the face plate and chassis cannot come apart freely.

While preferred embodiments of the present invention are described herein, it is not intended to limit the invention to such disclosure, and changes and modifications may be incorporated and embodied within the scope of the appended claims.

What is claimed is:

1. An apparatus for dispensing tickets, comprising:

a chassis;

an first roller rotatably mounted on said chassis;

a drive roller positioned to urge the tickets against said first roller when said tickets are inserted between the two rollers, said drive roller having an axis about which it rotates;

a drive assembly connected to said drive roller for rotating said drive roller to advance the tickets, said drive assembly being pivotable about said axis;

a brake wheel connected to said drive roller for rotation therewith, said brake wheel being spaced radially from said axis and supported on the drive assembly for movement therewith;

a pivot frame on which said drive roller and said drive assembly are supported, said pivot frame being pivotably connected to said chassis; and a brake member fixed to said chassis and positioned to be engaged by said brake wheel when said brake wheel moves toward said brake member.

2. An apparatus in accordance with claim 1 further comprising a drive shaft connected to said drive roller and through which said axis passes, said drive assembly connected to said drive roller by said shaft, and said shaft being supported on said pivot frame.

3. An apparatus in accordance with claim 1 wherein said drive assembly includes a motor having a motor shaft on which said drive roller is mounted for rotation therewith, said brake wheel being connected to said motor shaft.

4. An apparatus in accordance with claim 2 wherein said drive assembly includes a gear reduction box.

5. An apparatus in accordance with claim 1 wherein said brake member comprises a bracket having a flat end.

6. An apparatus in accordance with claim 1 wherein said brake member includes a polyurethane material positioned to be engaged by said brake wheel.

7. An apparatus in accordance with claim 1 further comprising a pin affixed to the drive assembly and a hole in the chassis through which the pin extends, said hole being sized larger than said pin to control the movement of said drive assembly.

8. An apparatus in accordance with claim 1 further comprising a spring positioned to urge said pivot frame in a direction to move said drive roller towards said first roller.

9. An apparatus for dispensing tickets, comprising:

a chassis;

an first roller rotatably mounted on said chassis;

a drive roller positioned to press the tickets against said first roller when said tickets are in the apparatus, said drive roller having an axis about which it rotates;

a drive shaft connected to said drive roller for rotation therewith;

a drive assembly supported on and connected to said drive shaft for rotating said drive shaft to rotate said drive roller and advance the tickets, said drive assembly being pivotable about said axis;

a brake wheel connected to said drive roller for rotation therewith, said brake wheel being supported on said drive assembly for movement therewith and spaced from said axis; and a brake member fixedly attached to said chassis and positioned to engage said brake wheel upon movement of said brake wheel into said brake member to impede rotation of said drive wheel.

10. A ticket apparatus in accordance with claim 9 wherein said brake member comprises a bracket.

11. A ticket apparatus in accordance with claim 9 wherein said drive assembly includes a motor having a motor shaft, said brake wheel being fixed to said motor shaft for rotation therewith.

12. A ticket apparatus in accordance with claim 9 further comprising a pivot frame on which said drive assembly and said drive roller are mounted, said pivot frame being pivotally connected to said chassis.

13. A ticket apparatus in accordance with claim 12 further comprising a biasing member acting on said pivot frame to urge said drive roller towards said first roller.

14. A ticket apparatus in accordance with claim 13 wherein said pivot frame is pivotally connected to said chassis by a pivotable connector, said drive roller being positioned between said pivotable connector and said first roller.

15. A ticket apparatus in accordance with claim 11 wherein said drive assembly comprises a gear reduction box.

16. An apparatus in accordance with claim 9 wherein said first roller is an idler roller.

17. An apparatus in accordance with claim 15 wherein said brake wheel is positioned on a side of said chassis opposite said gear reduction box.

18. An apparatus in accordance with claim 10 wherein said bracket includes polyurethane positioned to be engaged to the brake wheel.

19. An apparatus in accordance with claim 9 further comprising means for limiting the pivotal movement of said drive assembly about the drive roller shaft.

20. An apparatus in accordance with claim 19 wherein said means for limiting the pivotal movement includes a pin affixed to the drive assembly and a hole in the chassis through which the pin extends, said hole being sized larger than said pin to allow movement of said pin therein.

* * * * *